US011267238B2

(12) United States Patent
Woolthuis et al.

(10) Patent No.: US 11,267,238 B2
(45) Date of Patent: Mar. 8, 2022

(54) DEVICE AND A METHOD FOR CLAMPINGLY POSITIONING A HEAT TRANSFER SHEET AROUND A SUBSTRATE

(71) Applicant: BKW HOLDING B.V., Baarn (NL)

(72) Inventors: Bonne Klein Woolthuis, Baarn (NL); Harmen Klein Woolthuis, Baarn (NL)

(73) Assignee: Technotape Holding B.V., Baarn (NL)

( * ) Notice: Subject to any disclaimer, the term of this patent is extended or adjusted under 35 U.S.C. 154(b) by 269 days.

(21) Appl. No.: 16/482,338

(22) PCT Filed: Jan. 31, 2018

(86) PCT No.: PCT/NL2018/050071

§ 371 (c)(1),
(2) Date: Jul. 31, 2019

(87) PCT Pub. No.: WO2018/143805

PCT Pub. Date: Aug. 9, 2018

(65) Prior Publication Data

US 2020/0047484 A1 Feb. 13, 2020

(30) Foreign Application Priority Data

Feb. 1, 2017 (NL) ..... 2018283

(51) Int. Cl.
*B41F 16/00* (2006.01)

(52) U.S. Cl.
CPC ..... *B41F 16/0046* (2013.01); *B41F 16/0086* (2013.01)

(58) Field of Classification Search
CPC ..... B41F 16/0046
USPC ..... 101/407.1
See application file for complete search history.

(56) References Cited

U.S. PATENT DOCUMENTS 3,806,140 A * 4/1974 Robertson ..... B41F 19/06 279/2.22
4,628,857 A * 12/1986 Coningsby ..... B41F 17/20 101/120
4,874,454 A * 10/1989 Talalay ..... B41F 16/00 156/359
5,019,193 A * 5/1991 Aramini ..... B65C 3/145 156/215
5,876,547 A 3/1999 Kiesow
6,423,169 B1 * 7/2002 Cobb ..... B41J 2/0057 156/230

(Continued)

FOREIGN PATENT DOCUMENTS

DE 4432018 A1 5/1996
DE 10147550 A1 4/2003

*Primary Examiner* — Anthony H Nguyen
(74) *Attorney, Agent, or Firm* — Wilcox & Myers, P.C.; Jeffrey D. Myers

(57) ABSTRACT

A method and a device for clampingly holding against a substrate (8), for example a drinking cup, a heat transfer sheet (5) using a clamping sheet (2), comprising providing a device (1) with a substrate holder (10) for clampingly holding the substrate (8); providing a clamping sheet (2) with a width and a length, length being measured between longitudinal ends of the clamping sheet (2), and wherein at the longitudinal ends of the clamping sheet (2) coupling means (3) are provided; and positioning in catch means (4) of a positioning device the coupling means (3) for keeping the clamping sheet (2) in a first position.

10 Claims, 7 Drawing Sheets

(56) References Cited

U.S. PATENT DOCUMENTS

Figure 2:
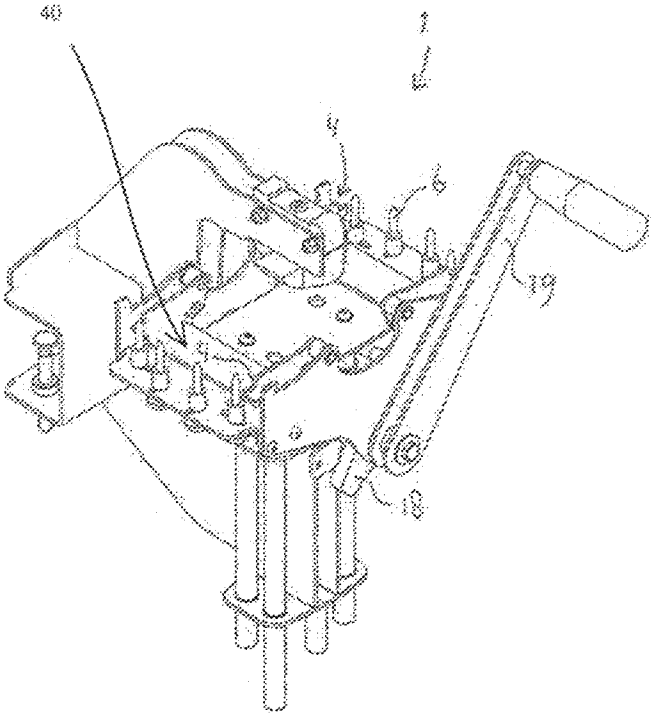

| | | | | |
|---|---|---|---|---|
| 9,272,567 | B2 * | 3/2016 | Polk | B65C 3/14 |
| 2006/0283555 | A1 * | 12/2006 | Green | B44C 1/1712<br>156/359 |

* cited by examiner

DEVICE AND A METHOD FOR CLAMPINGLY POSITIONING A HEAT TRANSFER SHEET AROUND A SUBSTRATE

The present invention relates to a method according to the preamble of claim 1 and to a device according to the preamble of claim 5. The method and device are suitable for tensely and tightly clamping a heat transfer sheet, also called a heat transfer paper, around a substrate, for example a drinking cup like a mug. By heating said combination to a predetermined temperature, the ink on said heat transfer paper will be transferred to the substrate and penetrate into a layer provided on the surface of said substrate. Such heat transfer paper is generally known in the art and comprises an ink or toner that is suitable for the stated purpose. Hereafter, reference will be made mostly to an ink, although the invention is not limited to ink alone. Every other suitable coloring substance is comprised in this term, for example toners. The sheet or paper must be kept tightly and evenly against the substrate for a sufficient time. With this technique, a very good ink transfer from a paper sheet to the substrate is possible.

Hereafter, reference will be made to a mug although without any limitation every other embodiments of a substrate are incorporated as well. The invention especially relates to substrates that have a cylindrical or conical shape such that the clamping sheet can be positioned tightly around same. The term "mug" has no limitation on the nature of the substrate, but is used only for simplicity.

A device as mentioned above is known in the art. For example, heaters are known, like MPress, HPN and Technotape (amongst which the Module Mug Press), holding a mug clamped inside a pre-shaped cylindrical recess and supplying heat from a heating mantle. A disadvantage of these known devices is that the wall of the device defining the pre-shaped recess receiving the mug. A suitable clamping is obtained only when the wall exactly follows the shape of the mug when clampingly holding same. In order to obtain a uniform pressure across the entire surface of the mug, the wall of the recess is provided with a compressible material, often a rubber. In order to be able to place the mug in the recess, the diameter of the wall of the recess will have to be larger than the outer diameter of the mug. This automatically means that during the step of clamping the wall of the recess against the mug, a large shear force is applied to the mug. Therefore, the heat transfer sheet, which is located between the mug and the wall of the recess, will also slide over the mug. The final positioning of the heat transfer sheet is therefore uncertain. Furthermore, there is a risk that residual heat in the wall of the recess causes ink to be transferred to the mug even when the wall is being clamped around the mug before the final position of the heat transfer sheet is reached. The image on the mug will therefore become blurred. Another disadvantage of these known devices is that the heat supply of the heating element into the heating jacket is poor, since the wall of the device is often a thick (up to one centimeter thick) rubber material that conducts heat poorly. A major disadvantage is also the limited shape equality between the wall of the recess and the mug; the material of the wall must have a relatively large rigidity in order to be able to develop sufficient pressure. The wall of the recess will therefore not provide optimum clamping after clamping, which leads to degassing taking place, resulting in smearing of ink over the mug.

All in all, this leads to a large dropout of mugs due to a poor quality image.

An alternative embodiment of a device for clamping a heat transfer paper to a mug is provided by a clamping device comprising a thick rubber clamp member carried within a steel frame surrounding the entire mug. The steel frame is passed around the mug with some force to place the rubber clamping element under extension against the surface of the mug and to keep it there in the stretched state. The disadvantage of this is that the clamping element slides over the mug, which can lead to smearing of the ink. The heat transfer paper is held clamped between the clamping member and the outer surface of the mug. Such a construction is intended to pass the thus clamped cup through an oven, as is the case in industrial applications. After a sufficient time at high temperature has been spent in the oven, the ink is transferred to the mug and the device is removed from the mug. A drawback of this known device is that the steel frame absorbs a lot of heat at every cycle that is spent in the over. The latter only means energy loss because that energy is not spent efficiently. The device must also first cool down before it can be removed from the substrate. Also, the residence time in the heating device is longer, because a part of the energy is used for heating up the device and not for heating up the substrate. Energy consumption and time are therefore adversely affected by use of this known device.

No device or method is known in the art with which the above-mentioned disadvantages can be eliminated.

The known devices and methods therefore need improvement in order to eliminate at least one of the aforementioned disadvantages.

In particular, there is a need for an improved device and method for clamping a heat transfer paper to a mug, whereby a certain positioning is obtained and chance of premature transfer of colors is prevented.

There is also a need for an improved device and method in which clamping a heat transfer paper against the outer surface of the mug is obtained fast and secure.

In particular, there is also a need for a device and method with which the heat transfer sheet can be clamped against a mug without any risk of smearing.

There is also a need for an improved device and method that can be easily used in an industrial application.

The object of the invention is therefore to provide an improved device and method of the type mentioned in the preamble which can provide at least one of the aforementioned needs.

In particular, it is the object of the invention to provide a device and method of the type mentioned in the preamble which can in a simple and secure manner clamp a heat transfer sheet around a substrate, for instance a mug or drinking cup.

In particular, the object of the invention is to provide a device and method which absorbs substantially no or only very little heat, so that a heat present in a heating device or to be supplied by a heating device is mainly used only for heating up the substrate and essentially not for heating up the device.

The invention therefore has the specific object of providing a method for clamping a transfer sheet around a substrate.

Another object of the invention is, in particular, to provide a method for transferring an image from a heat transfer sheet to a substrate.

In order to obtain at least one of the aforementioned advantages, the invention according to a first embodiment provides a method comprising the features of claim 1. This method has the advantage that a heat transfer sheet can be clamped very easily, tightly and securely around a substrate.

Because of the movement of the method adapted to the surface of the mug, the spreading of dye on the surface of the mug is precluded. Failure of product due to a poor quality image as a result of a shifted heat transfer sheet is thereby excluded.

It has also been found that with the method according to the invention clamping members can be used which contain very little material. The heat content is therefore very small, so that heat absorption by the device during the heat transfer process is virtually nil. Such a synergistic effect is a very great advantage.

According to a first embodiment, the invention therefore relates to a method for clampingly holding against a substrate, for example a drinking cup, a heat transfer sheet using a clamping sheet, comprising the steps of:—providing a device with a substrate holder for clampingly holding the substrate;—providing a clamping sheet with a width and a length, said length being measured between longitudinal ends of the clamping sheet, and wherein at the longitudinal ends of the clamping sheet coupling means are provided,—positioning in catch means of a positioning device the coupling means for keeping the clamping sheet in a first position; especially wherein the method further comprises the steps of:—positioning on the clamping sheet a heat transfer sheet wherein a layer comprising a transferrable ink is to be directed towards the substrate;—positioning against each other the substrate and the heat transfer sheet;—moving along the substrate the coupling means and at least partially extending the clamping sheet; and—moving towards each other the coupling means that are provided at respective ends of the clamping sheet for clamping the heat transfer sheet in a second position against the substrate wherein the clamping sheet has a substantially maximum extension.

The invention makes it very easy to keep a clamping sheet around the substrate. For this purpose, retention members, for example rings, can be placed on the two width sides of the coupling member about the adjacent protruding coupling means. Each retention member is then disposed around two protruding coupling means which protrude on the same width side of the clamping sheet and are provided at opposite longitudinal ends of the clamping sheet. The invention therefore further comprises, in such an embodiment, a retention member which can be passed around coupling means of the same width side positioned on opposite ends of the clamping sheet, to mutually couple these coupling means that are provided at opposite ends of the clamping sheet when positioning the clamping sheet around the substrate. Two separate retention members can be used, but also a single retention member can clamp both ends on both width sides to hold the clamping sheet in place around the substrate.

According to the invention the method preferably comprises that step of positioning in the second position on both sides of a support member of the substrate the coupling means that are positioned at opposite longitudinal ends of the clamping sheet. This is advantageous, for example, when the substrate is a mug provided with a support member and whereby a substantially complete clamping of the surface of the mug is obtained, from the bottom side to the top side.

To be able to obtain the transfer of the ink from the heat transfer sheet to the surface of the substrate, the method comprises the additional step of mutually coupling coupling means that are positioned at opposite longitudinal ends of the clamping sheet and placing the substrate and the heat transfer sheet and clamping sheet clamped thereon in a heating device for a predetermined time and at a predetermined temperature.

After a sufficient heating, the step is carried out of uncoupling the coupling means and removing the clamping sheet and the heat transfer sheet from the substrate. With this a substrate with an image is obtained. The image is a mirror image of the image on the heat transfer sheet.

According to a further embodiment, the invention relates to a device for carrying out the method according to the invention The device is embodied for device for clampingly holding against a substrate a flexible and stretchable clamping sheet and a heat transfer sheet, wherein the clamping sheet has a width and has a length, said length being measured between longitudinal ends of the clamping sheet and wherein at the longitudinal ends of the clamping sheet coupling means are provided, said device having a substrate holder with a positioning-axis which is embodied for holding the substrate, such that a longitudinal axis of the substrate substantially coincides with the positioning axis of the substrate holder, and wherein the device further comprises:—a table for carrying the clamping sheet and the heat transfer sheet in a first position at a distance from the substrate holder,—a translation device for moving the table and the substrate holder mutually towards each other, such that the translation is preferably performed substantially perpendicular to a surface of the table. The device is characterized in that in the device:—the substrate holder is coupled substantially rigidly to a main frame of the device,—the translation device is coupled movably with respect to the main frame of the device; said translation device comprising a first sub frame with a rotatable camshaft, a first cam of which runs over a first cam support rigidly coupled to the frame and of which a second cam runs over a second cam support forming part of a second sub frame, said second sub frame comprising catch means for holding the clamping sheet and the heat transfer sheet,—such that: when the camshaft rotates over a first rotation angle the first cam moves the two sub frames in the direction of the substrate, and in a subsequent rotation of the camshaft through a second rotation angle the second cam moves the second sub frame further such that the second sub frame is situated at least partly on both sides of the substrate. Such device provides and yields the advantages and effects as mentioned above with reference to the method according to the present invention.

Preferably, the device is embodied for positioning the clamping sheet around a cylindrical body. Such provides a simple embodiment, wherein all parts of the device can move symmetrically.

The device is especially suitable for use with a drinking cup, wherein the substrate is an outer wall of the drinking cup.

Preference is especially given to a device according to the invention wherein the table comprises mutually rotatable table parts, wherein: a central table part is rigidly coupled to the first sub frame and second table parts that are provided at ends of the central table part each are rotatably connected to the first sub frame around a rotation axis on the one hand and are rotatably connected to an arm that is provided at the second sub frame on the other hand; such that a translation of the second sub frame with respect to the first sub frame makes said both second table parts that are provided at the ends rotate around the rotation axis. This provides a certain positioning of the ends of the clamping sheet on both sides of the substrate, so that the heat transfer sheet and the clamping sheet lie in a secure manner against the surface of the substrate.

It is especially preferred that ends of the second table parts are displaced towards one another upon a rotation of the second table parts provided at the ends to a second position of the device and at least partly around the substrate, for positioning the clamping sheet and the heat transfer sheet under tension around the substrate. This provides a certain positioning of the ends of the clamping sheet on both sides of the substrate so that substantially the entire surface of the substrate is covered with the heat transfer sheet and the clamping sheet.

The reference to a table as mentioned above means that parts of the device are positioned such that a surface is defined on which one can position the clamping sheet, with the proviso that this may be a fictitious surface or plane that is defined only by four corner points, or by such four corner points in combination with one or more positioning devices that are positioned somewhere between said four corner points. The clamping sheet when positioned in said plane will yield a storage surface for the heat transfer sheet. A tense storage surface for the heat transfer sheet is preferably obtained by an embodiment wherein the table comprises a storage surface for the clamping sheet which is defined in the first position by a plane through catch means for holding coupling means that are provided at longitudinal ends of the clamping sheet. The clamping sheet is retained by means of the coupling means in the catch means such that the clamping sheet forms the storage surface.

So as to obtain a tense storage surface, the catch means are positioned such as to clampingly hold the clamping means of the clamping sheet in the catch means.

After clampingly positioning the clamping sheet against the substrate, with the heat transfer sheet clamped between the clamping sheet and the substrate, the clamping sheet, and also the device itself, are in the second position. The catch means are embodied such that, in the second position of the device, a translation of the coupling means towards each other disconnects same from the catch means. For example, a separate fixation member can move the coupling means towards each other and fix them mutually so that they are taken out of the catch means and clamped by the fixation member to hold the clamping sheet tightly around the substrate.

The clamping sheet, in the case of a substantially cylindrical substrate, is placed around the entire outer surface or the substantially entire outer surface of the substrate. The coupling means at the ends, when the clamping sheet is positioned around substantially the entire substrate, will be spaced some distance apart, the clamping sheet being slightly stretched. As a result, the clamping sheet will lie tightly around the substrate. The clamping sheet has been stretched in a first step and moved around the substrate in a subsequent step so that there is no longer any extension during the positioning of the clamping sheet against the substrate. The clamping sheet can also undergo a small extension during its positioning of the substrate, whereby substantially no extension and displacement of the clamping sheet takes place over the substrate. With sufficient extension the clamping sheet lies tightly over the heat transfer sheet and clamps that sheet tightly against the outer surface of the substrate, after which the retention member can couple the coupling means and keep the components mutually coupled. When the clamping sheet is positioned over the entire circumference of the substrate, it is preferred that the longitudinal ends of the clamping sheet are arranged to be coupled together, for instance by mutually coupling the respective coupling means without separate fixing means. This is particularly suitable when the substrate does not include a support member, such as cylindrical glasses and cups. Mugs are less suitable for this because of the existing ear that serves as a support member.

A particularly advantageous embodiment of the invention is obtained when the clamping sheet comprises a silicone rubber. Such a material is well resistant to high temperatures and temperature changes, which ensures a long life. Also silicone rubber in small thicknesses can be produced sufficiently strong and resilient, so that a certain application of the heat transfer sheet against the substrate is guaranteed.

In the device according to the invention the coupling means are embodied integrally with the clamping sheet. Preferably, the coupling means are embedded over the width of the clamping sheet in the material of the clamping sheet, yielding an excellent connection.

According to a further aspect, the present invention relates to a positioning device for positioning a heat transfer sheet in a device according to the invention comprising stop surfaces arranged at a circumference of a support surface for the heat transfer sheet, the stop surfaces being formed, for example, of pins, cams, angle profiles or combinations thereof.

This device according to the invention provides the advantages as mentioned above with reference to the method according to the invention. By using the aforementioned preferred embodiments of the method described above, the same advantages are obtained in the device.

Figure 1:
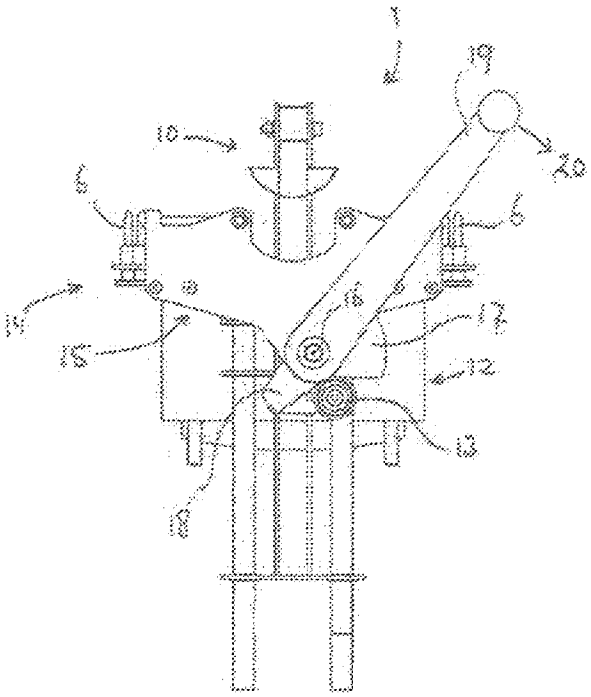
Figure 3:
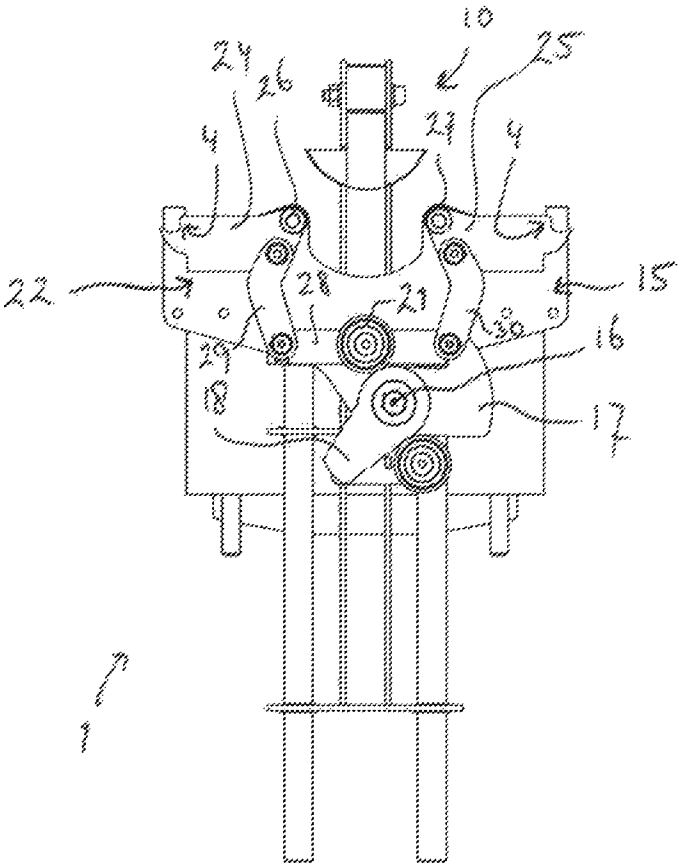
Figure 4:
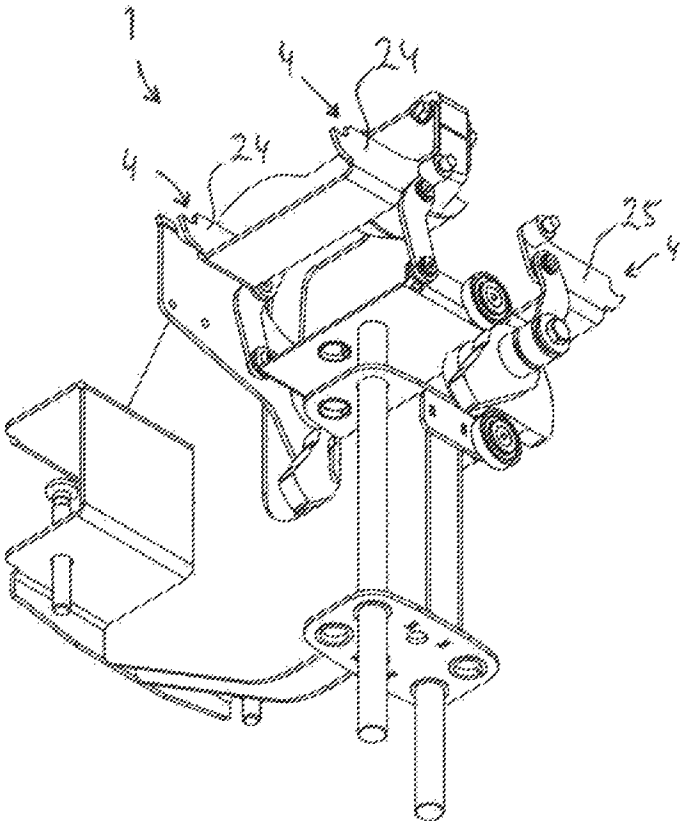
Figure 6:
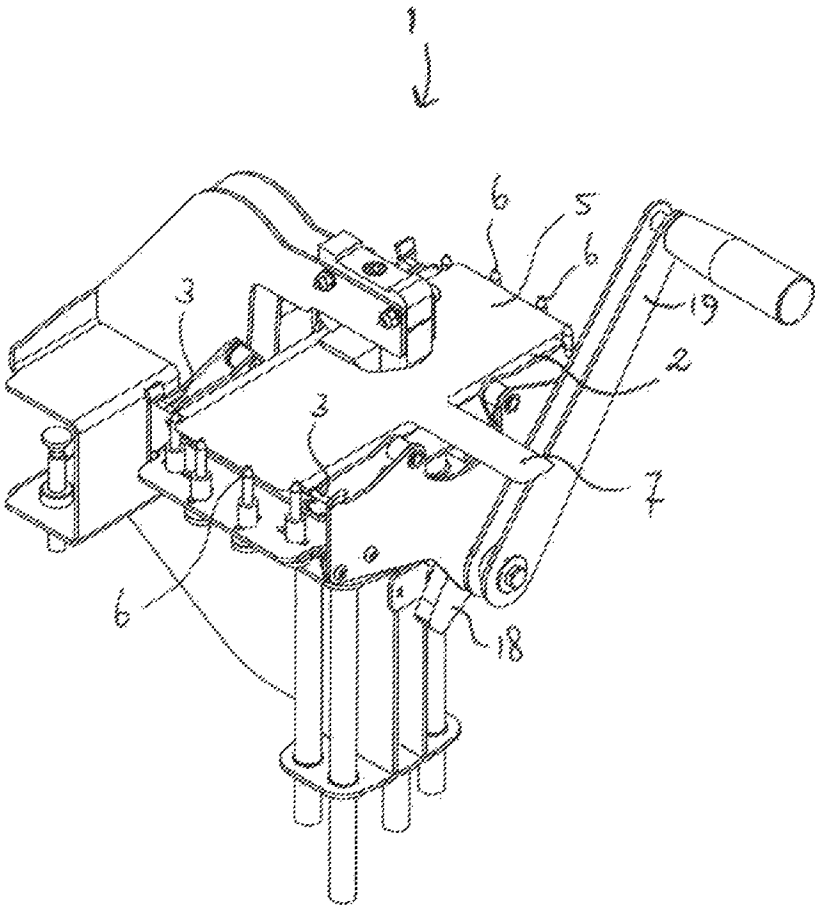
Figure 5:
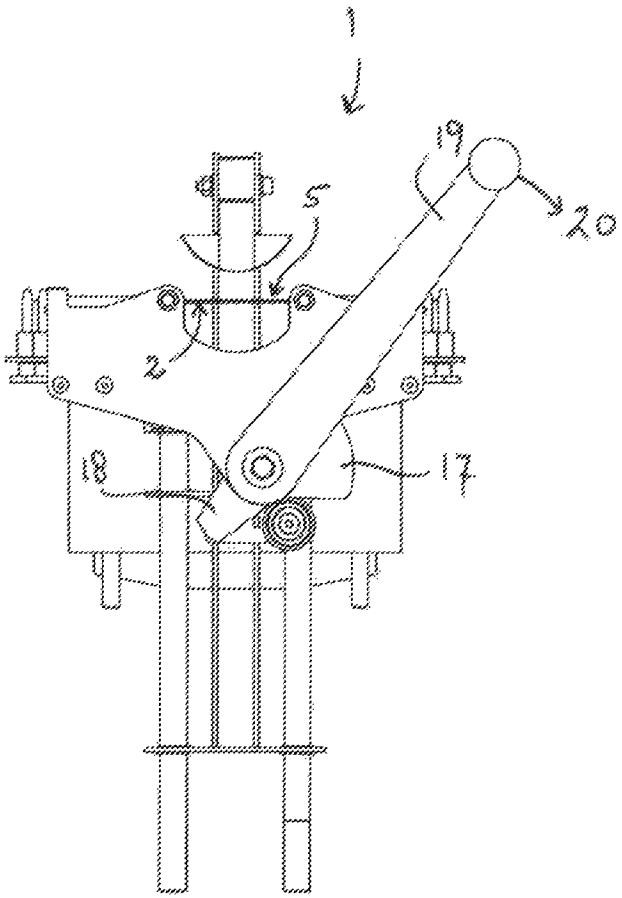
Figure 8:
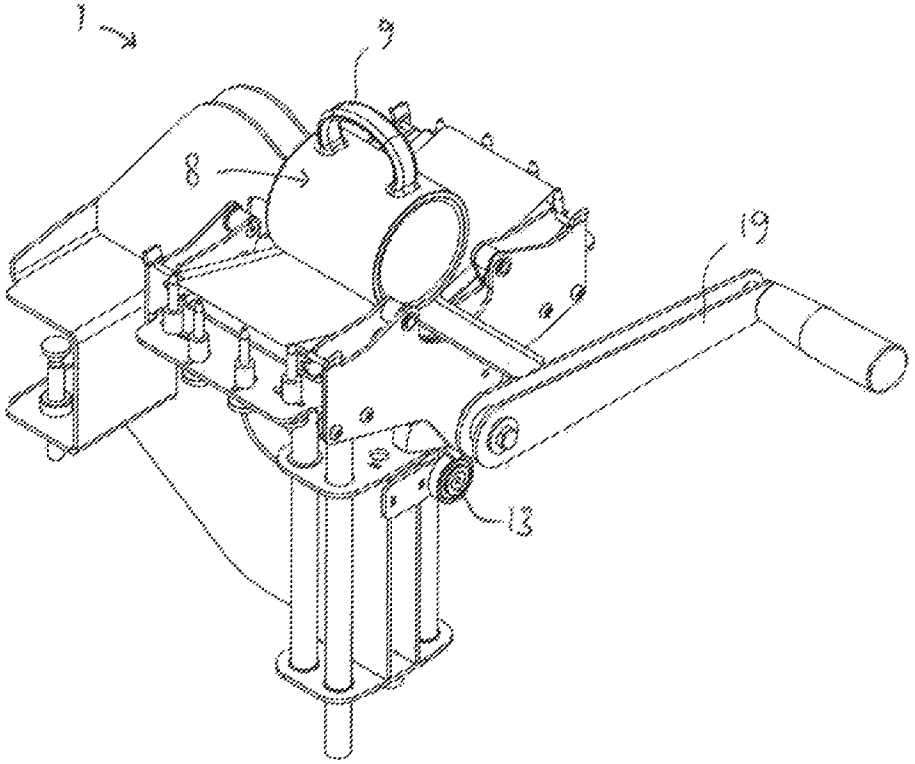
Figure 7:
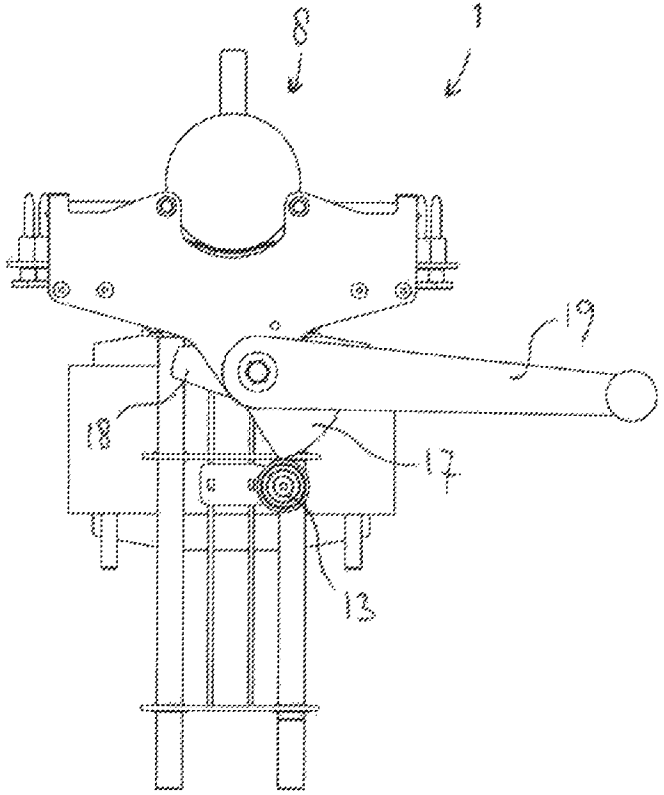
Figure 10:
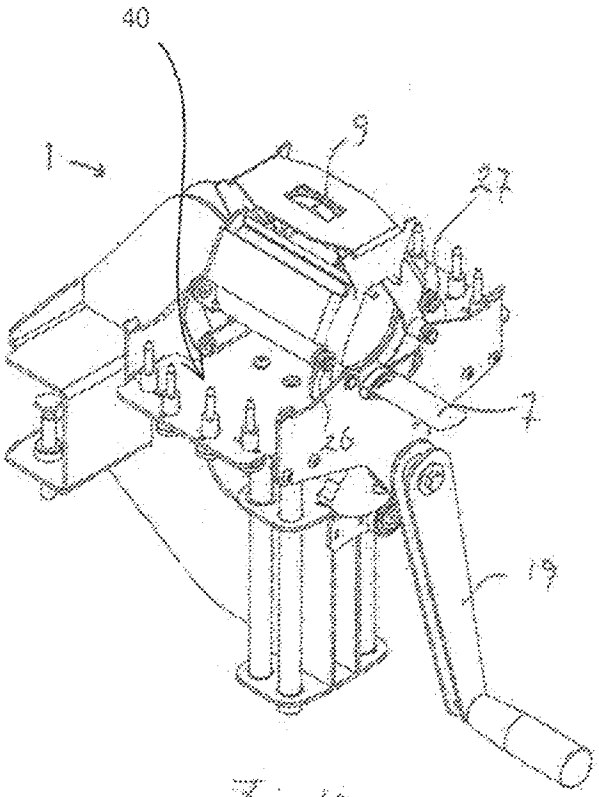
Figure 9:
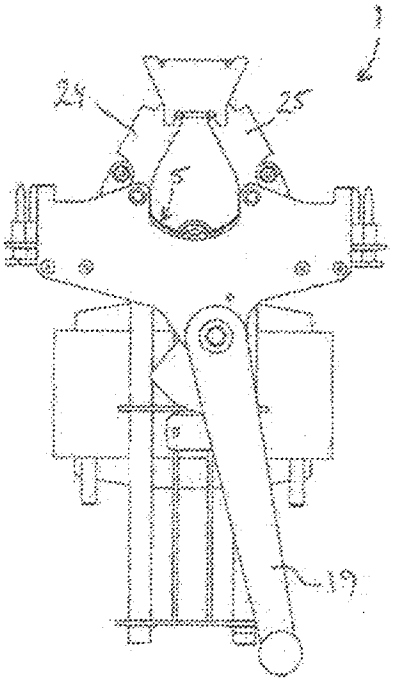
Figure 11:
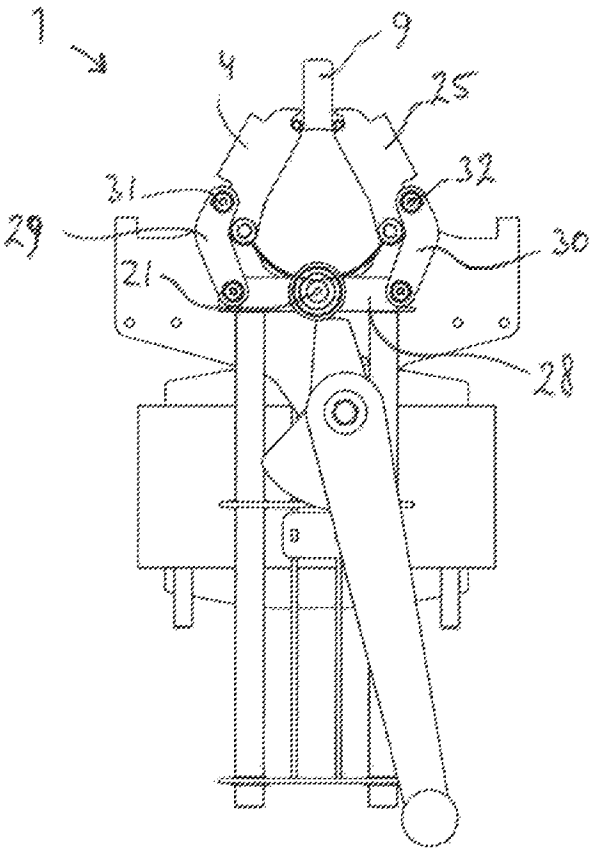
Figure 12:
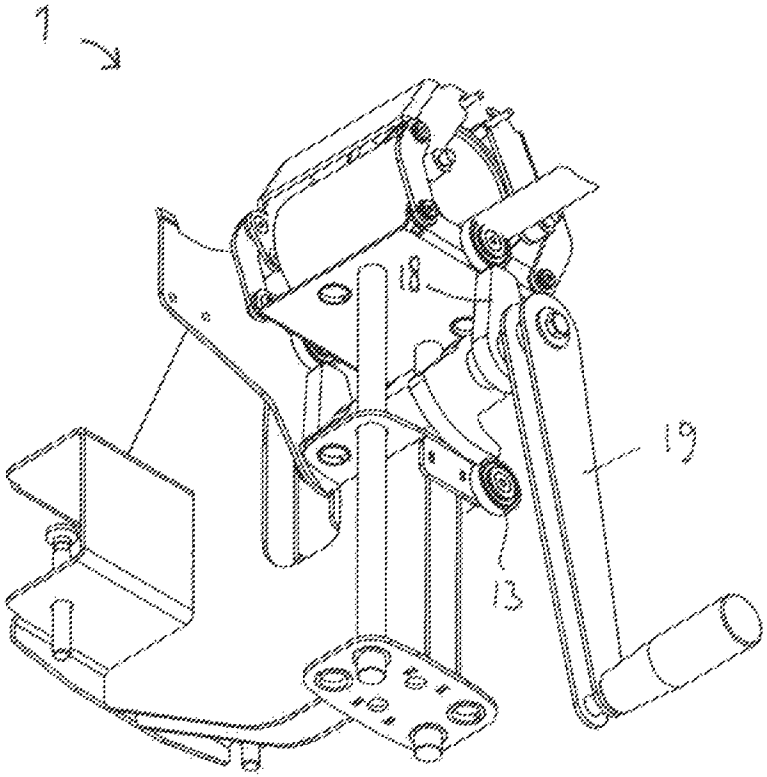
Figure 13:
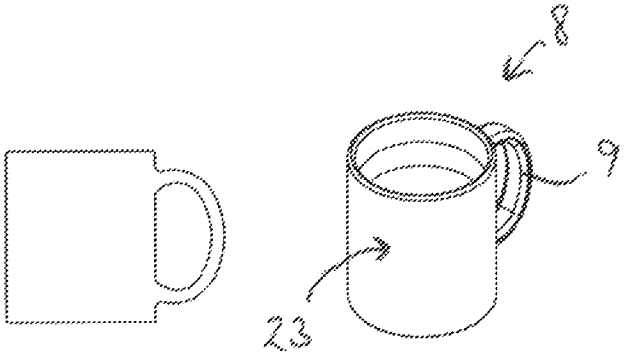

The invention will be explained in more detail below with reference to a drawing. The drawing shows in:

FIGS. 1, 3 and 5 a side view of the device according to the invention in a starting position, FIGS. 2, 4 and 6 a perspective view of the device according to the invention in a starting position, FIG. 7 a side view of the device according to the invention in a subsequent position, FIG. 8 a perspective view of the device according to the invention in a subsequent position, FIGS. 9 and 11 a side view of the device according to the invention in a final position, FIGS. 10 and 12 a perspective view of the device according to the invention in a final position, FIG. 13 a substrate for use in the invention.

In the figures, the same parts are indicated by the same reference numerals. However, not all parts necessary for a practical implementation of the invention are shown, due to the simplicity of the display.

FIGS. 1, 3 and 5 show a side view of a device 1 according to the invention in a starting position. FIG. 1 shows the side view of the entire device 1, while in FIG. 3 a part on the outside of the device for clarification has been removed. FIG. 5 shows a view as in FIG. 1, with the proviso that in FIG. 5 a clamping sheet 2 is placed. The clamping sheet 2 comprises coupling means 3 that are shown in FIG. 6, which are clamped in catch means 4 of the device 1, so that the clamping sheet 2 is kept taut. A heat transfer sheet 5 can be laid on the clamping sheet 2, whereby it can be easily centered within centering pawls 6. In the embodiment according to FIG. 6, the heat transfer sheet 5 has a handle 7 for easy handling.

A substrate 8, in FIGS. 7, 8, 9, 10, 11 and 12 designed as a mug 8 with an ear 9 as support member 9, is placed around the substrate holder 10 and clamped firmly there, so that it is coupled substantially immovably to the device 1. The ear 9 is turned away from the clamping sheet 2 and the heat transfer sheet 5.

The device 1 comprises a main frame 12 to which at least the substrate holder 10 and a cam support 13 are attached. This can be a bearing cam support 13. The device 1 furthermore comprises a translation element 14 which is displaceable relative to the main frame 12 and which comprises, inter alia, the catch means 4 for the clamping sheet 2 and the centering pawls 6 for the heat transfer sheet 5.

The translation member 14 comprises a first sub frame 15 having a cam shaft 16 with cams 17, 18. A first cam 17 extends over the cam support 13. Rotation of the handle 19 in the direction of the arrow 20 will cause a rotation of the camshaft 16 to be induced such that the first sub frame 15 in the embodiment shown in FIG. 7, 8 is moved towards the substrate holder 10. The cam 17 will occupy the position as shown in FIG. 7. Upon further rotation of the handle 19, the cam 18 will run over a cam support 21 which is attached to the second sub frame 22 (as for instance clearly shown in FIG. 3), so that the cam support 21 and the second sub frame 22 are moved away from the first sub frame 15. As a result, the catch means 4 of the device are brought to a position next to or even beyond the substrate 8 and laid against the substrate 8 so that the heat transfer sheet 5 lies tightly against the surface 23 of the substrate 8. Under the right conditions, the surface 23 of the substrate 8 can absorb ink present on the heat transfer sheet 5 so that an image is obtained on the surface 23 of the substrate 8.

To obtain the aforementioned movement of the catch means 4, reference is made to the construction as shown in FIG. 3 and FIG. 11 and FIG. 12. When the cam 18 is rotated, the cam support 21 will be moved away from the axis of rotation 16. The cam support 21 forms, together with the catch means 4, which are respectively provided on outer table parts 24, 25, part of the second sub frame 22. These outer table parts 24, 25 form in the first position as shown in FIGS. 1-6 the plane where the clamping sheet 2 is placed. The term "table" should be regarded as a fictitious indication of a table and does not have to form a physical support surface for the clamping sheet 2 to be placed. The table parts likewise comprise material parts which comprise the clamping members defining the fictive surface of the "table". The table parts 24, 25 are here formed by arms which at their ends comprise the catch means 4. In the embodiment shown in FIGS. 2 and 10, table 40 is shown.

The arms 24, 25 are coupled to the first sub frame 15 by means of shafts 26, 27. Further, the second sub frame 22 comprises a transverse arm 28 coupled to the cam support 21 and comprising two coupling arms 29, 30, each coupled by means of shafts 31, 32 to the arms. 24, 25, which coupling arms 29, 30 cause the arms 24, 25 to rotate about the axes 26 and 27, respectively, when the second sub-frame 22 is moved. As a result, the ends of the arms 24, 25 will fold around the substrate 8 and the clamping sheet 2 will allow the heat transfer sheet to lie tight against the surface of the substrate 8. By means of the catch means 4, the clamping sheet 2 will be under a continuous tension because the clamping sheet is slightly stretched during the movement.

The device 1 according to the invention has the advantage that during the first displacement is placed against the substrate 8 by means of the cam 17 over the cam support 13, whereafter during the second displacement, when the cam 18 is guided over cam support 21, a slight further extension takes place so that the heat transfer sheet is pressed tightly against the substrate. Due to the symmetrical embodiment and the fact that pressure is immediately applied during the first contact between heat transfer sheet and substrate 8, no shift of the heat transfer sheet 5 will occur.

The invention is not limited to the embodiments described above and shown in the figures. The invention is only limited by the appended claims. For example, the clamping sheet may extend beyond the top edge and bottom edge of the substrate.

The invention also extends over any combination of features which are described independently for this purpose.

The invention claimed is:

1. A device for clampingly holding against a substrate a flexible and stretchable clamping sheet and a heat transfer sheet, wherein the clamping sheet has a width and has a length, said length being measured between longitudinal ends of the clamping sheet, said device comprising coupling means at the longitudinal ends of the clamping sheet and a substrate holder with a positioning-axis for holding the substrate, such that a longitudinal axis of the substrate substantially coincides with the positioning axis of the substrate holder, and wherein the device further comprises:

a table for carrying the clamping sheet and the heat transfer sheet in a first position at a distance from the substrate holder; and a translation device for moving the table and the substrate holder mutually towards each other, such that the translation is performed substantially perpendicular to a surface of the table; and wherein:

the substrate holder is coupled substantially rigidly to a main frame of the device;

the translation device is coupled movably with respect to the main frame of the device;

said translation device comprising a first sub frame comprising a rotatable camshaft, comprising a first cam of which runs over a first cam support rigidly coupled to the main frame and a second cam which runs over a second cam support forming part of a second sub frame; and said second sub frame comprising catch means for holding the clamping sheet and the heat transfer sheet; and wherein when the rotatable camshaft rotates over a first rotation angle the first cam moves the two sub frames in the direction of the substrate; and wherein in a subsequent rotation of the rotatable camshaft through a second rotation angle the second cam moves the second sub frame such that the second sub frame is at least partly on both sides of the substrate.

2. The device according to claim 1, wherein the device is embodied for positioning the clamping sheet around a cylindrical body.

3. The device according to claim 1, wherein the substrate is an outer wall of a drinking cup.

4. The device according to claim 1, wherein the table comprises mutually rotatable table parts, wherein:

a central table part is rigidly coupled to the first sub frame; and second table parts are provided at ends of the central table part such that each are rotatably connected to the first sub frame around a rotation axis on the one hand and are rotatably connected to an arm that is provided at the second sub frame on the other hand; and such that a translation of the second sub frame with respect to the first sub frame makes said both second table parts that are provided at the ends rotate around the rotation axis.

5. The device according to claim 4, wherein ends of the second table parts are displaced towards one another upon a rotation of the second table parts provided at the ends to a second position of the device and at least partly around the substrate, for positioning the clamping sheet and the heat transfer sheet under tension around the substrate.

6. The device according to claim 1, additionally comprising catch means for holding coupling means that are provided at longitudinal ends of the clamping sheet, and wherein the table comprises a storage surface for the clamping sheet which is defined in a first position by a plane through the catch means.

7. The device according to claim 6, wherein the catch means are positioned such as to clampingly hold the clamping means of the clamping sheet in the catch means.

8. The device according to claim 6, wherein the catch means are embodied such that, in a second position of the device, a translation of the coupling means towards each other disconnects same from the catch means.

9. The device according to claim 1, wherein the clamping sheet comprises a silicone rubber.

10. The device according to claim 1, wherein the coupling means are embodied integrally with the clamping sheet.

* * * * *